US005279933A

United States Patent [19]

Gingello et al.

[11] Patent Number: 5,279,933

[45] Date of Patent: Jan. 18, 1994

[54] HIGH-CONTRAST PHOTOGRAPHIC ELEMENTS WITH IMPROVED PRINT-OUT CAPABILITY

[75] Inventors: Anthony D. Gingello; Ronald J. Schmidt, both of Rochester; Richard J. Kapusniak, Webster, all of N.Y.

[73] Assignee: Eastman Kodak Company, Rochester, N.Y.

[21] Appl. No.: 12,690

[22] Filed: Feb. 3, 1993

[51] Int. Cl.[5] ..... G03C 1/08

[52] U.S. Cl. ..... 430/509; 430/502; 430/568; 430/606; 430/264; 430/22

[58] Field of Search ..... 430/509, 502, 568, 606, 430/264, 22

[56] References Cited

U.S. PATENT DOCUMENTS

| | | | |
|---|---|---|---|
| 4,268,620 | 3/1981 | Iytaka et al. . | |
| 4,547,458 | 8/1985 | Iijima . | |
| 4,639,410 | 9/1987 | Mochizuki et al. . | |
| 4,659,647 | 11/1987 | Vacca et al. . | |
| 4,746,593 | 5/1988 | Kitchin et al. | 430/264 |
| 4,818,659 | 1/1989 | Takahashi et al. . | |
| 4,912,017 | 3/1990 | Takagi et al. | 430/264 |
| 4,939,067 | 4/1990 | Takagi et al. . | |
| 4,975,354 | 12/1990 | Machonkin et al. | 430/264 |
| 5,061,595 | 10/1991 | Gingello et al. | 430/264 |
| 5,122,434 | 6/1992 | Van Bockstaele et al. | 430/264 |

FOREIGN PATENT DOCUMENTS 1342687 6/1974 United Kingdom .

*Primary Examiner*—Charles L. Bowers, Jr.
*Assistant Examiner*—Thomas R. Neville
*Attorney, Agent, or Firm*—Alfred P. Lorenzo

[57] ABSTRACT

A high-contrast room-light-handleable black-and-white silver halide photographic element that is especially useful in the field of graphic arts is comprised of a support, an imaging layer containing doped silver halide grains with a mean grain size of less than 0.12 micrometers, and a print-out layer containing doped silver halide grains with a mean grain size in the range of from 0.14 to 0.4 micrometers. The element utilizes very slow speed emulsions which render it capable of being handled in room light and is able to print-out a visible image on normal exposure and develop to full density upon being processed in conventional developing solutions.

14 Claims, No Drawings

HIGH-CONTRAST PHOTOGRAPHIC ELEMENTS WITH IMPROVED PRINT-OUT CAPABILITY

FIELD OF THE INVENTION

This invention relates in general to photography and in particular to novel black-and-white silver halide photographic elements. More specifically, this invention relates to high-contrast room-light-handleable silver halide photographic elements which are especially useful in the field of graphic arts.

BACKGROUND OF THE INVENTION

High-contrast room-light-handleable black-and-white silver halide photographic elements are well known and widely used in graphic arts applications. The term "room-light-handleable" is intended to denote that the material can be exposed to a light level of 200 lux for several minutes without a significant loss in performance.

The silver halide emulsions utilized in high-contrast room-light-handleable photographic elements are slow speed emulsions, with the desired slow speed typically being achieved by the use of small grain sizes and by the doping of the silver halide grains with appropriate doping agents that control photographic speed. The incorporation of filter dyes in an overcoat layer of the photographic element to absorb unwanted light and decrease photographic speed is also a commonly employed technique.

The high-contrast room-light-handleable photographic elements that are in widespread use typically employ silver halide grains that are of small size; the term "small size" being used herein to mean a mean grain size in the range of from 0.14 to 0.4 micrometers. Certain advantages can be obtained by using silver halide grains of very small size; the term "very small size" being used herein to mean a mean grain size of less than 0.12 micrometers. Thus, for example, the use of very small size silver halide grains provides an improvement in safelight handling characteristics, permits the use of less silver and reduces the need to use filter dyes.

While high-contrast room-light-handleable photographic elements utilizing very small size silver halide grains have many advantages, as indicated above, they are lacking in certain desirable features, for example, they do not exhibit an adequate degree of print-out image upon exposure. To facilitate handling, it is advantageous that the photographic element print out an image, even though it is only faintly visible, upon normal exposure. Such a print-out image is readily obtained with silver halide grains of small size but not with silver halide grains of very small size, as those terms are used herein. Thus, for example, utilizing a silver halide emulsion layer with grains having a mean grain size of 0.16 micrometers will give a print-out image with an acceptable degree of visibility upon normal exposure but utilizing a silver halide emulsion layer with grains of the same halide content and content of doping agent but a mean grain size of 0.08 micrometers will not.

High-contrast room-light-handleable black-and-white photographic elements known heretofore have been lacking in one or more desirable features and this has hindered their commercial utilization. In particular, they have typically required a relatively high silver coverage and the use of expensive filter dyes and both of these features have added significantly to the cost of these products. Examples of patents describing such photographic elements include Takahashi et al, U.S. Pat. No. 3,818,659, issued Apr. 4, 1989; Miyata et al, U.S. Pat. No. 4,847,180, issued Jul. 11, 1989; Gingello et al, U.S. Pat. No. 5,061,595, issued Oct. 29, 1991; Kameoka et al, U.S. Pat. No. 5,085,970, issued Feb. 4, 1992; and Gingello et al, U.S. Pat. No. 5,175,073, issued Dec. 29, 1992.

It is toward the objective of providing an improved high-contrast room-light-handleable black-and-white silver halide element that is able to print-out a visible image on normal exposure and is capable of being developed to full density that the present invention is directed.

SUMMARY OF THE INVENTION

In accordance with this invention, a high-contrast room-light-handleable black-and-white silver halide photographic element that is especially adapted for use in the field of graphic arts is comprised of a support, an imaging layer containing doped silver halide grains with a mean grain size of less than 0.12 micrometers, and a print-out layer containing doped silver halide grains with a mean grain size of from 0.14 to 0.4 micrometers. The dopant level in the silver halide grains is controlled so that the photographic speed of the imaging layer is higher than the photographic speed of the print-out layer even though the grains of the imaging layer are smaller than the grains of the print-out layer. By use of two silver halide layers with the aforesaid characteristics, the element is capable of being handled in room light, is able to print out a visible image on normal exposure and is able to be developed to full density with conventional development.

The silver halide grains utilized in the imaging layer preferably have a mean grain size in the range of from 0.05 to 0.10 micrometers while the silver halide grains utilized in the print-out layer preferably have a mean grain size in the range of from 0.14 to 0.24 micrometers. Most preferred are grains with a mean grain size of 0.07 to 0.09 micrometers in the imaging layer and grains with a mean grain size of 0.15 to 0.20 micrometers in the print-out layer.

The novel photographic elements of this invention are characterized by a distribution of silver halide grains such that a plot of total volume of grains against grain size exhibits a peak in the range below 0.12 micrometers and a second peak in the range of from 0.14 to 0.4 micrometers.

The high-contrast room-light-handleable photographic element of this invention can optionally contain additional layers such as a backing layer and/or a protective overcoat layer but the essential requirement is the presence of two silver halide emulsion layers, one utilizing small size grains and the other utilizing very small size grains. The two silver halide emulsion layers can be arranged in either order on the support. In addition to providing a print-out image, the novel photographic element of this invention exhibits additional advantages including improved safelight characteristics, improved exposure latitude, and improved out-of-contact image quality.

The use of very small size silver halide grains in photographic elements is not in itself novel. Thus, for example, such grains are described in British Pat. No. 1,342,687, published Jan. 3, 1974; Iytaka et al, U.S. Pat. No. 4,268,620, issued May 19, 1981; Vacca et al, U.S. Pat. No. 4,659,647, issued Apr. 21, 1987; and Takagi et al, U.S. Pat. No. 4,939,067, issued Jul. 3, 1990. Also, the use of two emulsion layers with grains of different size is not in itself novel. Thus, for example, the use of two such layers is described in Iijima et al, U.S. Pat. No. 4,547,458, issued Oct. 15, 1985; Mochizuki et al, U.S. Pat. No. 4,639,410, issued Jan. 27, 1987, Kitchin et al, U.S. Pat. No. 4,746,593, issued May 24, 1988; and Takahashi et al, U.S. Pat. 4,818,659, issued Apr. 4, 1989. However, it was not known heretofore to use in combination a silver halide emulsion layer containing small size grains and a second silver halide emulsion layer containing very small size grains to produce a high-contrast room-light-handleable photographic element with the capability of providing a print-out image, as well as other improved properties.

DESCRIPTION OF THE PREFERRED EMBODIMENTS

The high-contrast room-light-handleable photographic elements of this invention can utilize any of the polymeric film supports known for use in the photographic arts. Typical of useful polymeric film supports are films of cellulose nitrate and cellulose esters such as cellulose triacetate and diacetate, polystyrene, polyamides, homo- and co-polymers of vinyl chloride, poly(vinylacetal), polycarbonate, homo- and co-polymers of olefins, such as polyethylene and polypropylene and polyesters or dibasic aromatic carboxylic acids with divalent alcohols, such as poly(ethylene terephthalate).

Polyester films, such as films of polyethylene terephthalate, have many advantageous properties, such as excellent strength and dimensional stability, which render them especially advantageous for use as supports in the present invention.

The polyester film supports which can be advantageously employed in this invention are well known and widely used materials. Such film supports are typically prepared from high molecular weight polyesters derived by condensing a dihydric alcohol with a dibasic saturated fatty carboxylic acid or derivatives thereof. Suitable dihydric alcohols for use in preparing polyesters are well known int her art and include any glycol, wherein the hydroxyl groups are on the terminal carbon atom and contain from 2 to 12 carbon atoms such as, for example, ethylene glycol, propylene glycol, trimethylene glycol, hexamethylene glycol, decamethylene glycol, dodecamethylene glycol, and 1,4-cyclohexane dimethanol. Dibasic acids that can be employed in preparing polyesters are well known in the art and include those dibasic acids containing from 2 to 16 carbon atoms. Specific examples of suitable dibasic acids include adipic acid, sebacic acid, isophthalic acid, and terephthalic acid. The alkyl esters of the above-enumerated acids can also be employed satisfactorily. Other suitable dihydric alcohols and dibasic acids that can be employed in preparing polyesters from which sheeting can be prepared are described in J. W. Wellman, U.S. Pat. No. 2,720,503, issued Oct. 11, 1955.

Specific preferred examples of polyester resins which, in the form of sheeting, can be used in this invention are poly(ethylene terephthalate), poly(cyclohexane 1,4-dimethylene terephthalate), and the polyester derived by reacting 0.83 mol of dimethyl terephthalate, 0.17 mol of dimethyl isophthalate and at least one mol of 1,4-cyclohexanedimethanol. U.S. Pat. No. 2,901,466 discloses polyesters prepared from 1,4-cyclohexanedimethanol and their method of preparation.

The thickness of the polyester sheet material employed in carrying out this invention is not critical. For example, polyester sheeting of a thickness of from about 0.05 to about 0.25 millimeters can be employed with satisfactory results.

In a typical process for the manufacture of a polyester photographic film support, the polyester is melt extruded through a slit die, quenched to the amorphous state, oriented by transverse and longitudinal stretching, and heat set under dimensional restraint. In addition to being directionally oriented and heat set, the polyester film can also be subjected to a subsequent heat relax treatment to provide still further improvement in dimensional stability and surface smoothness.

The photographic elements of this invention are high contrast materials with the particular contrast value, as indicated by gamma ($\gamma$), depending on the type of emulsion employed. Gamma is a measure of contrast that is well known in the art as described for example, in James, *The Theory of the Photographic Process,* 4th Ed., 502, MacMillan Publishing Co., 1977.

The useful silver halide emulsions for use in this invention include silver chloride, silver bromide, silver chlorobromide, silver bromoiodide, silver chloroiodide and silver chlorobromoiodide emulsions. Preferably the emulsions are high chloride emulsions in which the silver halide grains are at least 80 mole percent chloride. Most preferably, the emulsions are one hundred percent silver chloride.

The high-contrast room-light-handleable photographic elements of this invention include, in addition to a suitable support, a silver halide emulsion layer which serves as an imaging layer and a silver halide emulsion layer which serves as a print-out layer. A key feature differentiating these layers from one another is the size of the silver halide grains utilized, with the imaging layer containing silver halide grains with a mean grain size of less than 0.12 micrometers and the print-out layer containing silver halide grains with a mean grain size of from 0.14 to 0.4 micrometers. Methods for determining the mean grain size of silver halide grains are well known in the photographic art. They are described, for example, in James, *The Theory of the Photographic Process,*. 4th Ed., pages 100 to 102, MacMillan Publishing Co. (1977).

Since most applications in the field of graphic arts involve exposure of the photographic element from the emulsion side, in the novel photographic elements of this invention the print-out layer is typically located so that it overlies the imaging layer. For applications in which the photographic element is exposed through the back, the order of the print-out and imaging layers can be reversed so that the imaging layer overlies the print-out layer.

The silver halide emulsions utilized in this invention employ silver halide grains in which a doping agent has been incorporated to control the speed. Such use of doping agents is very well known in the photographic art. The doping agents are typically added during the crystal growth stages of emulsion preparation, for example, during initial precipitation and/or physical ripening of the silver halide grains. Rhodium is a particularly well known doping agent, and can be readily incorporated in the grains by use of suitable salts such as rhodium trichloride. Other particularly useful doping agents include iridium, ruthenium, rhenium, chromium and osmium.

As hereinabove described, the dopant level in the silver halide grains employed in this invention is controlled so that the speed of the imaging layer is higher than the speed of the print-out layer even though the grains of the imaging layer are smaller than the grains of the print-out layer. Since photograpic speed is decreased with increasing concentration of doping agent, this result is easily achieved by employing a lower concentration of doping agent in the grains of the imaging layer than in the grains of the print-out layer. Alternatively, the desired control of photographic speed can be achieved by use of different doping agents in the print-out emulsion and the imaging emulsion.

It should be noted that it is the amount of dopant per grain of silver halide that determines the photographic speed. Thus, emulsions of very small grain size, such as the imaging emulsions utilized herein, have many more grains per mole of silver halide than emulsions of small grain size, such as the print-out emulsions utilized herein. Thus, the imaging emulsion and the print-out emulsion could contain the same concentration of doping agent on the basis of moles of doping agent per mole of silver halide but the amount of doping agent per grain will be much greater for the grains of the print-out emulsion than for the grains of the imaging emulsion. The result of this difference in amount of doping agent per grain is that the speed of the imaging layer will be higher than the speed of the print-out layer even though the grains of the imaging layer are smaller than the grains of the print-out layer.

McDugle et al U.S. Pat. No. 4,933,272, issued Jun. 12, 1990, the disclosure of which is incorporated herein by reference, discloses silver halide emulsions comprised of radiation sensitive silver halide grains exhibiting a face centered cubic crystal lattice structure internally containing a nitrosyl or thionitrosyl coordination ligand and a transition metal chosen from groups 5 to 10 inclusive of the periodic table of elements. These emulsions are preferred for use in the high-contrast room-light-handleable photographic elements of this invention.

In accordance with the aforesaid U.S. Pat. No. 4,933,272, the dopants containing within the silver halide grains are transition metal coordination complexes which contain one or more nitrosyl or thionitrosyl ligands. These ligands have the formula:

$$-\overset{\overset{\displaystyle X}{\|}}{N}-$$

where X is oxygen in the case of nitrosyl ligands and sulfur in the case of thionitrosyl ligands.

Preferred dopants utilized in this invention are transition metal coordination complexes having the formula:

$$[M(NX)(L)_5]_n$$

wherein:

M is a ruthenium, rhenium, chromium, osmium or iridium transition metal;

X is oxygen or sulfur;

L is a ligand; and n is −1, −2, or −3.

As in the aforesaid U.S. Pat. No. 4,933,272, all references herein to periods and groups within the periodic table of elements are based on the format of the periodic table adopted by the American Chemical Society and published in the *Chemical and Engineering News,* Feb. 4, 1985, p. 26. In this form the prior numbering of the periods was retained, but the Roman numeral numbering of groups and designations of A and B groups (having opposite meanings in the U.S. and Europe) was replaced by a simple left to right 1 through 18 numbering of the groups.

In addition to the doped silver halide grains, the silver halide emulsions employed in this invention also contain a hydrophilic colloid that serves as a binder or vehicle. The proportion of hydrophilic colloid can be widely varied, but typically is within the range of from about 20 to 250 g/mole silver halide. The presence of excessive levels of hydrophilic colloid can reduce maximum image density and, consequently, contrast. Thus, for $\gamma$ values of 10 or more, the vehicle is preferably present at a level of less than 200 g/mole silver halide.

The hydrophilic colloid is preferably gelatin, but many other suitable hydrophilic colloids are also known to the photograpic art and can be used alone or in combination with gelatin. Suitable hydrophilic colloids include naturally occurring substances such as proteins, protein derivatives, cellulose derivatives—e.g., cellulose esters, gelatin—e.g., alkali-treated gelatin (cattle bone or hide gelatin) or acid-treated gelatin (pigskin gelatin), gelatin derivatives—e.g., acetylated gelatin, phthalated gelatin and the like, polysaccharides such as dextran, gum arabic, zein, casein, pectin, collagen derivatives, collodion, agar-agar, arrowroot, albumin, and the like.

In addition to the hydrophilic colloid and the silver halide grains, the radiation-sensitive silver halide emulsion layers employed in this invention can include a polymer latex which serves to improve the dimensional stability of the film. Polymers usable in latex form for this purpose are very well known in the photographic art. The requirements for such a polymer latex are (1) that it not interact with the hydrophilic colloid such that normal coating of the emulsion layer is not possible, (2) that it have optical properties, i.e., refractive index, similar to that of the hydrophilic colloid, and (3) that it have a glass transition temperature such that it is plastic at room temperature. Preferably, the glass transition temperature is below 20° C.

The polymer latex useful in the present invention is an aqueous dispersion of a water-insoluble polymer. It is incorporated in an emulsion layer in an amount that is typically in the range of from about 0.2 to about 1.5 parts per part by weight of the hydrophilic colloid.

The synthetic polymeric latex materials referred to herein are generally polymeric materials which are relatively insoluble in water compared to water-soluble polymers, but have sufficient water solubility to form colloidal suspensions of small polymeric micelles. Typical latex polymeric materials can be made by rapid copolymerization with vigorous agitation in a liquid carrier of at least one monomer which would form a hydrophobic homopolymer. In certain preferred embodiments, from about 1 to about 30 percent, by weight, of units of monomer containing the water-solubilizing group is present in the copolymer product. Copolymers prepared by this method and analogous methods provide discrete micelles of the copolymer which have low viscosities in aqueous suspensions. Typical useful copolymers include interpolymers of acrylic esters and sulfoesters as disclosed in Dykstra, U.S. Pat. No. 3,411,911, issued Nov. 19, 1968, interpolymers of acrylic esters and sulfobetains as described in Dykstra and Whiteley, U.S. Pat. No. 3,411,912, issued Nov. 19, 1968, interpolymers of alkyl acrylates and acrylic acids as disclosed in Ream and Fowler, U.S. Pat. No. 3,287,289, issued Nov. 22, 1966, interpolymers of vinyl acetate, alkyl acrylates and acrylic acids as disclosed in Corey, U.S. Pat. No. 3,296,169, and interpolymers as disclosed in Smith, U.S. Pat. No. 3,459,790, issued Aug. 5, 1969. Polymeric latex materials can also be made by rapid polymerization with vigorous agitation of hydrophobic polymers when polymerized in the presence of high concentrations of surfactants which contain water-solubilizing groups. The surfactants are apparently entrained in the micelle and the solubilizing group of the surfactant provides sufficient compatibility with aqueous liquids to provide a dispersion very much like a soap. Generally good latex materials are also disclosed in Nottorf, U.S. Pat. No. 3,142,568, issued Jul. 28, 1964; White, U.S. Pat. No. 3,193,386, issued Jul. 6, 1965; Houck et al, U.S. Pat. No. 3,062,674, issued Nov. 6, 1962; and Houck et al, U.S. Pat. No. 3,220,844, issued Nov. 30, 1965.

The synthetic polymeric latex materials are generally polymerized in a manner to produce micelles of about 1.0 micron average diameter or smaller to be highly useful in photographic emulsions and preferably the discrete micelles are less than 0.3 micron in average diameter. Generally, the micelles can be observed by photomicrographs when incorporated in gelatino emulsions, however, it is understood that some coalescing can occur when the emulsions are coated and dried.

In one embodiment, the latex polymers which can be used according to this invention are acrylic interpolymers, i.e., those interpolymers prepared from polymerizable acrylic monomers containing the characteristic acrylic group

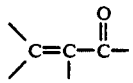

Such polymers are conveniently prepared by the interpolymerization of an acrylic monomer with at least one dissimilar monomer which can be another acrylic monomer or some other different polymerizable ethylenically unsaturated monomer. It is, of course, understood that the acrylic interpolymers employed in the practice of this invention are compatible with gelatin and have a Tg (glass transition temperature) of less than 20° C. (Tg can be calculated by differential thermal analysis as disclosed in "Techniques and Methods of Polymer Evaluation", Vol. 1, Marcel Dekker, Inc., N.Y., 1966).

A particularly preferred polymer latex for use in a silver halide emulsion layer is poly(methylacrylate-co-2-acrylamido-2-methyl propane sulfonic acid) which is comprised of repeating units of the formula:

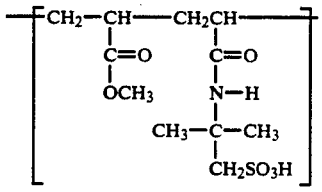

The thickness of the radiation-sensitive silver halide emulsion layers in the photographic elements of this invention is typically in the range of from about 1 to about 9 microns, and more preferably in the range of from about 2 to about 4 microns.

In addition to silver halide grains, a hydrophilic colloid and a polymer latex, the radiation-sensitive layers employed in the photographic elements of this invention can contain an effective amount of a hydrazine compound which functions as a nucleating agent. As an alternative to incorporation in one or both radiation-sensitive layers, the hydrazine compound can be incorporated in a layer contiguous thereto. Any hydrazine compound that functions as a nucleator and is capable of being incorporated in a silver halide emulsion layer, or a layer contiguous thereto, can be used in the practice of this invention. Hydrazine compounds can, of course, be included both in the silver halide emulsion layers and in one or more other layers of the photographic element.

Preferred photographic elements within the scope of this invention include elements containing a hydrazine compound of the formula:

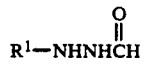

wherein $R^1$ is a phenyl nucleus having a Hammett sigma value-derived electron withdrawing characteristic of less than +0.30.

In the above formula, $R^1$ can take the form of a phenyl nucleus which is either electron donating (electropositive) or electron withdrawing (electronegative); however, phenyl nuclei which are highly electron withdrawing produce inferior nucleating agents. The electron withdrawing or electron donating characteristic of a specific phenyl nucleus can be assessed by reference to Hammett sigma values. The phenyl nucleus can be assigned a Hammett sigma value-derived electron withdrawing characteristic which is the algebraic sum of the Hammett sigma values of its substituents (i.e., those of the substituents, if any, to the phenyl group). For example, the Hamett sigma values of any substituents to the phenyl ring of the phenyl nucleus can be determined algebraically simply by determining from the literature the known Hammett sigma values for each substituent and obtaining the algebraic sum thereof. Electron donating substituents are assigned negative sigma values. For example, in one preferred form, $R^1$ can be a phenyl group which is unsubstituted. The hydrogens attached to the phenyl ring each have a Hammett sigma value of 0 by definition. In another form, the phenyl nuclei can include halogen ring substituents. For example, ortho- or para-chloro or fluoro substituted phenyl groups are specifically contemplated, although the chloro and fluoro groups are each mildly electron withdrawing.

Preferred phenyl group substituents are those which are not electron withdrawing. For example, the phenyl groups can be substituted with straight or branched chain alkyl groups (e.g., methyl, ethyl, n-propyl, isopropyl, n-butyl, isobutyl, n-hexyl, n-octyl, tert-octyl, n-decyl, n-dodecyl and similar groups). The phenyl groups can be substituted with alkoxy groups wherein the alkyl moieties thereof can be chosen from among the alkyl groups described above. The phenyl groups can also be substituted with acylamino groups. Illustrative acylamino groups include acetylamino, propanoylamino, butanoylamino, octanoylamino, benzoylamino, and similar groups.

In one particularly preferred form the alkyl, alkoxy and/or acylamino groups are in turn substituted with a conventional photographic ballast, such as the ballasting moieties of incorporated couplers and other immobile photographic emulsion addenda. The ballast groups typically contain at least eight carbon atoms and can be selected from both aliphatic and aromatic relatively unreactive groups, such as alkyl, alkoxy, phenyl, alkylphenyl, phenoxy, alkylphenoxy and similar groups.

The alkyl and alkoxy groups, including ballasting groups, if any, preferably contain from 1 to 20 carbon atoms, and the acylamino groups, including ballasting groups, if any, preferably contain from 2 to 21 carbon atoms. Generally, up to about 30 or more carbon atoms in these groups are contemplated in their ballasted form. Methoxyphenyl, tolyl (e.g., p-tolyl and m-tolyl) and ballasted butyramidophenyl nuclei are specifically preferred.

Examples of the specifically preferred hydrazine compounds are the following:

1-Formyl-2-(4-[2-(2,4-di-tert-pentylphenoxy)-butyramido]phenyl)hydrazine

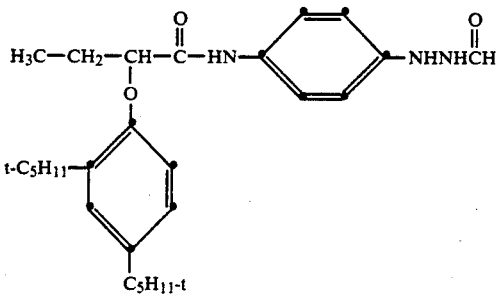

1-Formyl-2-phenylhydrazine

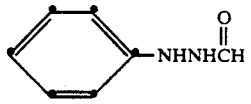

1-Formyl-2-(4-methoxylphenyl)hydrazine

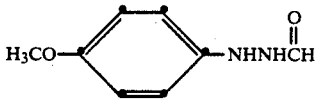

1-Formyl-2-(4-chlorophenyl)hydrazine

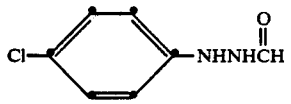

1-Formyl-2-(4-fluorophenyl)hydrazine

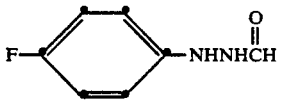

1-Formyl-2-(2-chlorophenyl)hydrazine

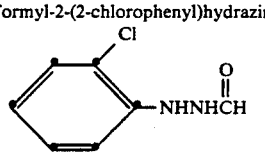

1-Formyl-2-(p-tolyl)hydrazine

-continued

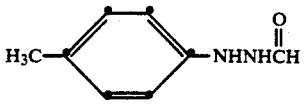

Preferred photographic elements within the scope of this invention also include those in which the hydrazide comprises an adsorption promoting moiety. Hydrazides of this type contain an unsubstituted or mono-substituted divalent hydrazo moiety and an acyl moiety. The adsorption promoting moiety can be chosen from among those known to promote adsorption of photographic addenda to silver halide grain surfaces. Typically, such moieties contain a sulfur or nitrogen atom capable of complexing with silver or otherwise exhibiting an affinity for the silver halide grain surface. Examples of preferred adsorption promoting moieties include thioureas, heterocyclic thioamides and triazoles. Exemplary hydrazides containing an adsorption promoting moiety include:

1-[4-(2-formylhydrazino)phenyl]-3-methyl thiourea

3-[4-(2-formylhydrazino)phenyl-5-(3-methyl-2-benzoxazolinylidene)rhodanine-6-([4-(2-formylhydrazino)phenyl]ureylene)-2-methylbenzothiazole N-(benzotriazol-5-yl)-4-(2-formylhydrazino)-phenylacetamide N-(benzotriazol-5-yl)-3-(5-formylhydrazino-2-methoxyphenyl)propionamide and N-2-(5,5-dimethyl-2-thiomidazol-4-yl-idenimino)ethyl-3-[5-(formylhydrazino)-2-methoxyphenyl]propionamide.

Hydrazine compounds incorporated in the photographic element are typically employed in a concentration of from about $10^{-4}$ to about $10^{-1}$ mole per mole of silver, more preferably in an amount of from about $5\times10^{-4}$ to about $5\times10^{-2}$ mole per mole of silver, and most preferably in an amount of from about $8\times10^{-4}$ to about $5\times10^{-3}$ mole per mole of silver. The hydrazines containing an adsorption promoting moiety can be used at a level as low as about $5\times10^{-6}$ mole per mole of silver.

An especially preferred class of hydrazine compounds for use in the elements of this invention are the hydrazine compounds described in Machonkin et al, U.S. Pat. No. 4,912,016 issued Mar. 27, 1990,. These compounds are aryl hydrazides of the formula:

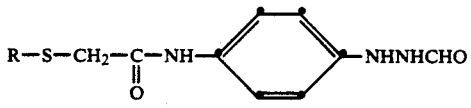

where R is an aklyl or cycloaklkyl group.

Another especially preferred class of hydrazine compounds for use in the elements of this invention are the hydrazine compounds described in Looker et al, U.S. Pat. No. 5,104,769, issued Apr. 14, 1992.

The hydrazine compounds described in the aforesaid U.S. Pat. No. 5,104,769, have one of the following structural formulae:

I

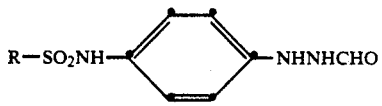

-continued or

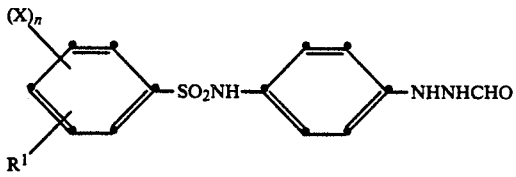

II wherein;

R is alkyl having from 6 to 18 carbon atoms or a heterocylic ring having 5 to 6 ring atoms, including ring atoms of sulfur or oxygen;

$R^1$ is alkyl or alkoxy having from 1 to 12 carbon atoms;

X is alkyl, thioalkyl or alkoxy having from 1 to about 5 carbon atoms; halogen; or $—NHCOR^2$, $—NHSO_2R^2$, $—CONR^2R^3$ $—SO_2R^2R^3$ or where $R^2$ and $R^3$, which can be the same or different, are hydrogen or alkyl having from 1 to about 4 carbon atoms; and n is 0, 1 or 2.

Alkyl groups represented by R can be straight or branched chain and can be substituted or unsubstituted. Substituents include alkoxy having from 1 to about 4 carbon atoms, halogen atoms (e.g. chlorine and fluorine), or $—NHCOR^2$ or $—NHSO_2R^2$ where $R^2$ is as defined above. Preferred R alkyl groups contain from about 8 to about 16 carbon atoms since alkyl groups of this size impart a greater degree of insolubility to the hydrazide nucleating agents and thereby reduce the tendency of these agents to be leached during development from the layers in which they are coated into developer solutions.

Heterocyclic groups represented by R include thienyl and furyl, which groups can be substituted with alkyl having from 1 to about 4 carbon atoms or with halogen atoms, such as chlorine.

Alkyl or alkoxy groups represented by $R^1$ can be straight or branched chain and can be substituted or unsubstituted. Substituents on these groups can be alkoxy having from 1 to about 4 carbon atoms, halogen atoms (e.g. chlorine or fluorine); or $—NHCOR^2$—or $—NHSO_2R^2$ where $R^2$ is as defined above. Preferred alkyl or alkoxy groups contain from 1 to 5 carbon atoms in order to impart sufficient insolubility to the hydrazide nucleating agents to reduce their tendency to being leached out of the layers in which they are coated by developer solution.

Alkyl, thioalkyl and alkoxy groups which are represented by X contain from 1 to about 5 carbon atoms and can be straight or branched chain. When X is halogen, it may be chlorine, flourine, bromine or iodine. Where more than one X is present, such substituents can be the same or different.

Yet another especially preferred class of hydrazine compounds are aryl sulfonamidophenyl hydrazides containing ethyleneoxy groups which have the formula:

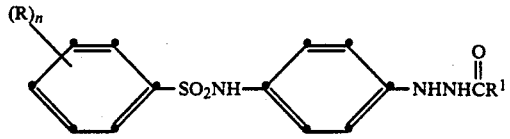

II where each R is a monovalent group comprised of at least three repeating ethyleneoxy units, n is 1 to 3, and $R^1$ is hydrogen or a blocking group. These compounds are described in Machonkin et al, U.S. Pat. No. 5,041,355, issued Aug. 20, 1991.

Still another especially preferred class of hydrazine compounds are aryl sulfonamidophenyl hydrazines containing both thio and ethyleneoxy groups which have the formula:

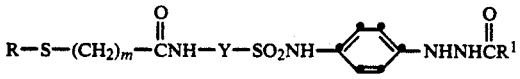

where R is a monovalent group comprised of at least three repeating ethyleneoxy units m is 1 to 6, Y is a divalent aromatic radical, and $R^1$ is hydrogen or a blocking group. The divalent aromatic radical represented by Y, such as a phenylene radical or naphthalene radical, can be unsubstituents or substituted with one or more substituents such as alkyl, halo, alkoxy, haloalkyl or alkoxyalkyl. These compounds are described in Machonkin et al, U.S. Pat. No. 4,988,604, issued Jan. 29, 1991.

Still another preferred class of hydrazine compounds for use in the elements of this invention are aryl sulfonamidophenyl hydrazides containing an alkyl pyridinium group which have the formula:

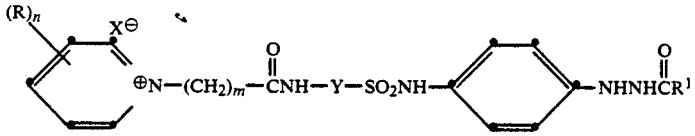

where each R is an alkyl group, preferably containing 1 to 12 carbon atoms, n is 1 to 3, X is an anion such as chloride or bromide, m is 1 to 6, Y is a divalent aromatic radical, and $R^1$ is hydrogen or a blocking group. The divalent aromatic radical represented by Y, such as a phenylene radical or naphthalene radical, can be unsubstituted or substituted with one or more substituents such as alkyl, halo, alkoxy, haloalkyl or alkoxyalkyl. Preferably the sum of the number of carbon atoms in the alkyl groups represented by R is at least 4 and more preferably at least 8. The blocking group represented by $R^1$ can be, for example:

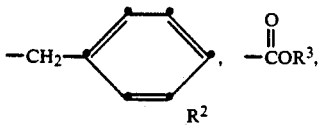

-continued

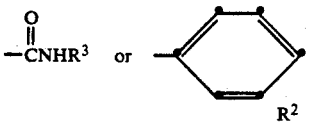

where $R^2$ is hydroxy or a hydroxy-substituted alkyl group having from 1 to 4 carbon atoms and $R^3$ is an alkyl group having from 1 to 4 carbon atoms. These compounds are described in Looker et al, U.S. Pat. No. 4,994,365, issued Feb. 19, 1991.

While certain preferred hydrazine compounds that are useful in this invention have been specifically described hereinabove, it is intended to include within the scope of this invention all hydrazine compound "nucleators" known to the art. Many such nucleators are described in "Development Nucleation By Hydrazine And Hydrazine Derivatives", Research Disclosure, Item 23510, Vol. 235, Nov. 10, 1983 and in numerous patents including U.S. Pat. Nos. 4,166,742, 4,168,977, 4,221,857, 4,224,401, 4,237,214, 4,241,164, 4,243,739, 4,269,929, 4,272,606, 4,272,614, 4,311,781, 4,332,878, 4,358,530, 4,377,634, 4,385,108, 4,429,036, 4,447,522, 4,540,655, 4,560,638, 4,569,904, 4,618,572, 4,619,886, 4,634,661, 4,650,746, 4,681,836, 4,686,167, 4,699,873, 4,722,884, 4,725,532, 4,737,442, 4,740,452, 4,912,016, 4,914,003, 4,988,604, 4,994,365, 5,041,355 and 5,104,767.

The total concentration of silver in the novel photographic elements of this invention, that is the sum of the silver in the imaging layer and the silver in the print-out layer, is typically in the range of from about 0.5 to about 5.5 grams of silver per square meter, more preferably in the range of from about 1.5 to about 4.5 grams of silver per square meter, and most preferably in the range of from about 2.5 to about 3.5 grams of silver per square meter.

The weight ratio of silver halide grains in the imaging layer to silver halide grains in the print-out layer is typically in the range of from about 0.5:1 to about 80:1, more preferably in the range of from about 1.5:1 to about 20:1, and most preferably in the range of from about 2:1 to about 5:1.

The amount of doping agent incorporated in the silver halide grains employed in this invention can vary over a wide range, as desired. Suitable amounts of doping agent for use in the silver halide grains of the imaging layer are typically in the range of from about 0.001 about 2 millimoles per mole of silver halide while suitable amounts of doping agent for use in the silver halide grains of the print-out layer are typically in the range of from about 0.01 to about 1 millimoles per mole of silver halide. As previously indicated herein, the amounts of doping agent are selected such that the speed of the imaging layer is greater than the speed of the print-out layer. The speed will depend on both the particular doping agent employed and the amount in which it is used.

The same dopant need not be used in the silver halide grains of the imaging layer as is used in the silver halide grains of the print-out layer. The morphology and halide content of the silver halide grains in the imaging and print-out layers can also be different. The essential requirement is merely that the dopant level of the silver halide grains of the imaging layer and the dopant level of the silver halide grains of the print-out layer are such that the photographic speed of the imaging layer is higher than the photographic speed of the print-out layer. The imaging layer has all the benefits of utilizing very small silver halide grains, while grains of larger size are used in the print-out layer to obtain the desired print-out image.

A particularly preferred photographic element within the scope of this invention comprises an imaging layer containing silver chloride grains having a mean grain size in the range of from 0.07 to 0.09 micrometers and a content of ruthenium doping agent in the range of from 0.03 to 0.25 millimoles per mole of silver halide and a print-out layer containing silver chloride grains having a mean grain size in the range of from 0.15 to 0.20 micrometers and a content of ruthenium doping agent in the range of from 0.03 to 0.25 millimoles per mole of silver halide.

The novel photographic elements of this invention can include an overcoat layer containing a hydrophilic colloid and a matting agent. The hydrophilic colloid can be selected from among those described above as being useful in the emulsion layers. Most preferably, the hydrophilic colloid in the overcoat layer is gelatin.

Discrete solid particles of a matting agent, typically having an average particle size in the range of from about 1 to about 5 microns and preferably in the range of from about 2 to 4 microns, can be utilized in the overcoat layer. The matting agent is typically employed in an amount of from about 0.02 to about 1 part per part by weight of the hydrophilic colloid. Either organic or inorganic matting agents can be used. Examples of organic matting agents are particles, often in the form of beads, of polymers such as polymeric esters of acrylic and methacrylic acid, e.g., poly(methylmethacrylate), cellulose esters such as cellulose acetate propionate, cellulose ethers, ethyl cellulose, polyvinyl resins such as poly(vinyl acetate), styrene polymers and copolymers, and the like. Examples of inorganic matting agents are particles of glass, silicon dioxide, titanium dioxide, magnesium oxide, aluminum oxide, barium sulfate, calcium carbonate, and the like. Matting agents and the way they are used are further described in U.S. Pat. Nos. 3,411,907 and 3,754,924.

Particles used as matting agents in the present invention can be of essentially any shape. Their size is typically defined in terms of mean diameter. Mean diameter of a particle is defined as the diameter of a spherical particle of identical mass. Polymer particles that are in the form of spherical beads are preferred for use as matting agents.

The thickness of the overcoat layer is typically in the range of from about 0.2 to about 1 micron, preferably in the range of from about 0.3 to about 0.6 micron and most preferably in the range of from about 0.35 to about 0.45 micron.

The side of the support opposite to the emulsion layer is typically coated with an antihalation layer whose function is to prevent light that passes through the film support from being reflected into the image-forming layer and thereby causing an undesired spreading of the image which is known as halation. The antihalation layer may in turn be overcoated with another layer which serves as a protective outermost layer. Alternatively, antihalation protection can be provided by incorporating a non-migrating dye in a layer under the emulsion layers.

The photographic elements of this invention which contain a hydrazine compound can be processed in developing solutions of the type which contain an amino compound which functions as a contrast-promoting agent or, as it is sometimes referred to, as a "booster." These are described in Nothnagle, U.S. Pat. No. 4,269,929, issued May 26, 1981. An example of this type of developing solution is KODAK ULTRATEC DEVELOPER. They can also be processed in conventional developing solutions which do not contain an amino compound which functions as a contrast-promoting agent. An example of this type of developing solution is KODAK UNIVERSAL RAPID ACCESS DEVELOPER.

The photographic elements of this invention can optionally contain an "incorporated booster." Amino compounds which are useful as incorporated boosters, i.e., boosters which are incorporated in the photographic element rather than in the developing solution, are described in Machonkin et al, U.S. Pat. No. 4,975,354, issued Dec. 4, 1990.

The amino compounds useful as "incorporated boosters" described in the aforesaid U.S. Pat. No. 4,975,354 are amino compounds which:

(1) comprise at least one secondary or tertiary amino group;

(2) contain within their structure a group comprised of at least three repeating ethyleneoxy units, and (3) have a partition coefficient, of at least one, preferably at least three, and most preferably at least four.

Included within the scope of the amino compounds utilized in this invention as "incorporated boosters" are monoamines, diamines and polyamines. The amines can be aliphatic amines or they can include aromatic or heterocyclic moieties. Aliphatic, aromatic and heterocyclic groups present in the amines can be substituted or unsubstituted groups. Preferably, the amino compounds employed in this invention as "incorporated boosters" are compounds of at least 20 carbon atoms.

Preferred amino compounds for use as "incorporated boosters" are bis-tertiary-amines which have a partition coefficient of at least three and a structure represented by the formula:

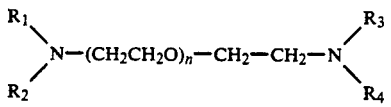

wherein n is an integer with a value of 3 to 50, and more preferably 10 to 50, $R_1$, $R_2$, $R_3$and $R_4$ are, independently, alkyl groups of 1 to 8 carbon atoms, $R_1$ and $R_2$ taken together represent the atoms necessary to complete a heterocyclic ring, and $R_3$ and $R_4$ taken together represent the atoms necessary to complete a heterocyclic ring.

Another advantageous group of amino compounds for use as "incorporated boosters" are bis-secondary amines which have a partition coefficient of at least three and a structure represented by the formula:

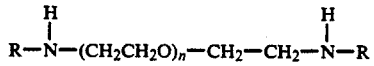

wherein n is an integer with a value of 3 to 50, and more preferably 10 to 50, and each R is, independently, a linear or branched, substituted or unsubstituted, alkyl group of at least 4 carbon atoms.

Preferably the group comprised of at least three repeating ethyleneoxy units is directly linked to a tertiary amino nitrogen atom and most preferably the group comprised of at least three repeating ethyleneoxy units is a linking group joining tertiary amino nitrogen atoms of a bis-tertiary-amino compound.

The amino compound utilized as an "incorporated booster" is typically employed in an amount of from about 1 to about 25 millimoles per mole of silver, and more preferably in an amount of from about 5 to about 15 millimoles per mole of silver.

Other amino compounds useful as "incorporated boosters" are described in Yagihara et al, U.S. Pat. No. 4,914,003 issued Apr. 3, 1990. The amino compounds described in this patent are represented by the formula:

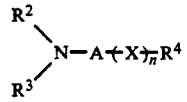

wherein $R^2$ and $R^3$ each represent a substituted or unsubstituted alkyl group or may be linked to each other to form a ring; $R^4$ represents a substituted or unsubstituted alkyl, aryl or heterocyclic group; A represents a divalent linkage; X represents —$CONR^5$—, —O—$CONR^5$, —$NR^5CONR^5$, —$NR^5COO$—, —COO—, —OCO—, —CO—, —$NR^5CO$—, —$SO^2NR^5$—, —$NR^5SO_2$—, —$SO_2$—, —S—or —O—group in which $R^5$ represents a hydrogen atom or a lower alkyl group and n represents 0 or 1, with the proviso that the total number of carbon atoms contained in $R^2$, $R^3$, $R^4$ and A is 20 or more.

As lithographic-type photographic elements, the high-contrast room-light-handleable elements of this invention are preferably utilized (exposed and processed) as sheet films. As such, the films preferably have low curl (i.e., less than about 40 ANSI curl units at 21° C. and 15% relative humidity, using ANSI PH 1.29-1971, which calls for matching the curl of sample strips on a template of curves of varying radii to determine the radius of curvature and reporting the value of 100/R as the degree of curl where R is the radius of curvature in inches) and high dimensional stability (humidity coefficient, defined as % change in linear dimension divided by change in percent humidity over a 15-50% relative humidity range at 21° C, of less than about 0.0015).

To demonstrate the utility of using both an imaging layer and a print-out layer, the photographic elements of this invention were evaluated in accordance with the following characteristics:

Multi-Layer Image Quality (MLIQ)

In a contact exposure process, the original which is to be exposed can, in some instances, be a multi-layer original, that is, an original in which two or more elements have been stacked together as an assembly. Such a multi-layer assembly can include both line image originals and dot image originals. MLIQ is a quantitative parameter indicating how well a contact film images characters that are at least one layer out of contact. The lower the value for MLIQ, the better the performance. In the evaluation of MLIQ, Kanji characters, i.e., characters belonging to the Kanji system of writing that is used in Japan, are simultaneously exposed with scanner halftone dots in the E-E configuration. The measure of MLIQ reported herein is the percent dot area of a 150 line per inch halftone positioned in the same layer as the Kanji characters. The value of this dot pattern, measured at the exposure where the E-E scanner halftone in direct contact reaches 5% dot beyond exact dot for dot, is a measure of the quality of the Kanji characters. The quality increases as the percent dot area decreases. Further description of MLIQ can be obtained by reference to Takahashi et al U.S. Pat. No. 4,818,659, issued Apr. 4, 1989.

Dot Growth (DG)

Dot growth is a quantitative parameter that indicates how the photographic element responds to increasing amounts of exposure. The DG number is a ratio of the percent dot area gained divided by the amount of exposure (in log units) needed to make that gain. DG values are calculated along the linear portion of the curve, prior to halation causing a significant increase in dot movement. A high dot growth value means that the photographic element has poor exposure latitude, but has fast dry dot etching (percent dot value moves fast with little overexposure). A low dot growth value indicates that the photographic element has good exposure latitude (percent dot value remains relatively constant regardless of exposure) but is poor for dry dot etching.

Print-Out

Print-out is the visible image that occurs due to exposure and thus is an image that can be seen prior to processing. It facilitates determination of whether or not a proper exposure has been made. In the examples herein, the print-out value was quantified by exposing the photographic element with an exposure that equals plus 10% in the midtone range, fixing prior to standard processing and then reading the print-out image with an X-Rite Densitometer (UV mode). A larger print-out density indicates that the element has a more clearly visible print-out image, as desired. Print-out is also measured subjectively by visual observation and rated on a scale in which 1 is best and 10 is poorest.

Safelight

The safelight test predicts how a photographic element will respond to low levels of room lighting. Variables involved in the test include bulb type, illumination level, whether or not the bulb is sleeved, the type of sleeve, the light source for creating tint, the practical exposure for creating tint, the processing conditions and the chemistry. The safelight exposure can be either in the pre-exposure step in which the element receives safelight and then is exposed to tint with high intensity light, or in the post-exposure step in which the element is exposed to tint with high intensity light and then receives safelight. The safelight test monitors the midtone percent dot area and the D-min patch as a function of safelight time. The amount of time it takes to change the midtone of 1% and 2% is reported. Safelight parameters are initially determined in seconds but are then put into log space and corrected for practical speed. A positive number indicates an improvement in safelight.

In the examples reported hereinbelow, a developer concentrate was formulated as follows and diluted at a ratio of one part of concentrate to four parts of water to produce a working strength developing solution with a pH of 10.4.

| | |
|---|---|
| Sodium metabisulfite | 145 g |
| 45% Potassium hydroxide | 178 g |
| Diethylenetriamine pentaacetic acid pentasodium salt (40% solution) | 15 g |
| Sodium bromide | 12 g |
| Hydroquinone | 65 g |
| 1-Phenyl-4-hydroxymethyl-4-methyl-3-pyrazolidone | 2.9 g |
| Benzotriazole | 0.4 g |
| 1-Phenyl-5-mercaptotetrazole | 0.05 g |
| 50% Sodium hydroxide | 46 g |
| Boric acid | 6.9 g |
| Diethylene glycol | 120 g |
| 47% Potassium Carbonate | 120 g |
| Water to one liter | |

The invention is further illustrated by the following examples of its practice.

Example 1

Element A, which is employed herein as a control, is comprised of a poly(ethylene terephthalate) film support, a silver halide emulsion laying overlying the film support, and a protective overcoat layer overlying the silver halide emulsion layer. On its opposite side, the film support is coated with an antihalation layer and a backing layer which overlies the antihalation layer. The silver halide emulsion layer is comprised of a negative-working silver chloride emulsion, doctored with 4-hydroxy-6-methyl-2-methylmercapto- 1,3,3a,7-tetraazaindene, containing silver halide grains capable of forming a surface latent image. The silver halide grains are 100% chloride, have a mean grain size of 0.08 micrometers and a ruthenium content of 0.13 millimoles per mole of silver chloride. The silver chloride is present at a concentration of 2.6 grams of silver per square meter. The silver halide emulsion layer contains gelatin as a binder and a polymer latex, poly(methylacrylate-co-2-acrylamido-2-methyl propane sulfonic acid), to improve dimensional stability.

Element B is identical to element A except that the silver chloride is present at a concentration of 2.1 grams of silver per square meter and it additionally includes a second silver halide emulsion layer that serves as a print-out layer. The print-out layer is interposed between the first silver halide emulsion layer and the overcoat layer. The print-out layer contains gelatin, polymer latex, silver halide grains which are 100% chloride, have a mean grain size of 0.16 micrometers and a ruthenium content of 0.13 millimoles per mole of silver chloride and was coated at a silver chloride concentration of 0.80 grams of silver per square meter.

Each of elements A and B was exposed on a graphic arts contact printer unit, developed for 22 seconds at 35° C. in the developing solution described hereinabove and fixed for 22 seconds at 35° C. Each element was evaluated with respect to MLIQ, dot growth, print-out and safelight characteristics and the results are summarized in Table I below.

TABLE I

| | Print-Out | | | | Safelight |
|---|---|---|---|---|---|
| Element | UV Density | Rating | DG | MLIQ | Improvement |
| A | 0.008 | 6 | 26 | 67 | 0 |
| B | 0.016 | 2 | 17 | 64 | 0.13 |

As indicated by the data in Table I, element B, which contained both an imaging layer and a print-out layer in accordance with this invention, exhibited superior properties in comparison with element A which contained only an imaging layer. In particular, element B provided markedly enhanced print-out as shown by both the UV-density measurement and the subjective rating, provided a lower dot growth value which is indicative of improvement in exposure latitude, provided a lower MLIQ value which is evidence of improved out-of-contact image quality, and provided significantly improved safelight protection at a matched practical speed.

Example 2

A photographic element, designated element C, which contained only an imaging layer was prepared in the same manner as element A except that the ruthenium content was 0.08 millimoles per mole of silver chloride. Elements D, E and F were also prepared and were identical to element C except that they additionally contained a print-out layer comprised of gelatin, polymer latex, and silver halide grains which are 100% chloride, have a mean grain size of 0.16 micrometers and a ruthenium content of 0.13 millimoles per mole of silver chloride. The concentration of silver in the imaging layer of element C was 2.6 grams per square meter and the silver concentrations in elements D, E and F were as follows:

| Element | Silver in Imaging Layer ($g/m^2$) | Silver in Print-Out Layer ($g/m^2$) |
|---|---|---|
| D | 2.42 | 0.27 |
| E | 2.26 | 0.54 |
| F | 2.10 | 0.81 |

Elements C, D, E and F were evaluated in the same manner as elements A and B and the results obtained are summarized in Table II below.

TABLE II

| Element | Print-Out Rating | DG | MLIQ | Safelight Improvement |
|---|---|---|---|---|
| C | 6 | 24 | 72 | 0 |
| D | 5 | 18 | 67 | 0.17 |
| E | 4 | 17 | 67 | 0.13 |
| F | 2 | 17 | 66 | 0.17 |

As indicated by the data in Table II, elements D, E and F, which contained both an imaging layer and a print-out layer in accordance with this invention, exhibited superior properties in comparison with element C which contained only an imaging layer. In particular, elements D, E and F provided enhanced print-out, lower dot growth values, lower MLIQ values and improved safelight protection.

The invention has been described in detail with particular reference to preferred embodiments thereof, but it will be understood that variations and modifications can be effected within the spirit and scope of the invention.

We claim:

1. A high-contrast room-light-handleable black-and-white silver halide photographic element; said element comprising:
   (1) a support,
   (2) an imaging layer containing doped silver halide grains with a mean grain size of less than 0.12 micrometers, and
   (3) a print-out layer containing doped silver halide grains with a mean grain size of from 0.14 to 0.4 micrometers;

the dopant level of the silver halide grains of said imaging layer and the dopant level of the silver halide grains of said print-out layer being such that the photographic speed of said imaging layer is higher than the photographic speed of said print-out layer.

2. A photographic element as claimed in claim 1, wherein the silver halide grains of said imaging layer have a mean grain size of 0.05 to 0.10micrometers and the silver halide grains of said print-out layer have a mean grain size of 0.14 to 0.24 micrometers.

3. A photographic element as claimed in claim 1, wherein the silver halide grains of said imaging layer have a mean grain size of 0.07 to 0.09 micrometers and the silver halide grains of said print-out layer have a mean grain size of 0.15 to 0.20 micrometers.

4. A photographic element as claimed in claim 1, wherein the silver halide grains of both said imaging layer and said print-out layer are at least 80 mole percent chloride.

5. A photographic element as claimed in claim 1, wherein the silver halide grains of both said imaging layer and said print-out layer are one hundred percent chloride.

6. A photographic element as claimed in claim 1, wherein the silver halide grains of both said imaging layer and said print-out layer are dope with a doping agent selected from the group consisting of rhodium, iridium, ruthenium, rhenium, chromium and osmium.

7. A photographic element as claimed in claim 1, wherein the weight ratio of silver halide grains in said imaging layer to silver halide grains in said print-out layer is in the range of from about 2:1 to about 5:1.

8. A photographic element as claimed in claim 1, wherein the silver halide grains of said imaging layer are doped with ruthenium in an amount of 0.03 to 0.25 millimoles per mole of silver halide and the silver halide grains of said print-out layer are doped with ruthenium in an amount of 0.03 to 0.25 millimoles per mole of silver halide.

9. A photographic element as claimed in claim 1, wherein the silver halide grains of both said imaging layer and said print-out layer are doped with a doping agent, containing a nitrosyl or thionitrosyl coordination ligand and a transition metal of groups 5 to 10 of the periodic table of elements, in an amount sufficient to provide a level of photosensitivity which permits room-light-handling of said element.

10. A photographic element as claimed in claim 1, additionally containing a hydrazine compound which functions as a nucleating agent.

11. A photographic element as claimed in claim 10, wherein said hydrazine compound is 1-formyl-2-(4-[2-(2,4-di-tert-pentylphenoxy)butyramido]phenyl)-hydrazine.

12. A photographic element as claimed in claim 10, additionally containing an amino compound which functions as an incorporated booster.

13. A photographic element as claimed in claim 1, additionally comprising an overcoat layer containing a hydrophilic colloid and a matting agent.

14. A high-contrast room-light-handleable black-and-white silver halide photographic element; said element comprising:
   (1) a poly(ethylene terephthalate) film support;
   (2) an imaging layer containing silver chloride grains with a mean grain size of 0.07 to 0.09 micrometers doped with 0.13 millimoles of ruthenium per mole of silver chloride; and
   (3) a print-out layer containing silver chloride grains with a mean grain size of 0.15 to 0.20 micrometers doped with 0.13 millimoles of ruthenium per mole of silver chloride.

* * * * *